US009993869B2

(12) United States Patent
Atkins et al.

(10) Patent No.: US 9,993,869 B2
(45) Date of Patent: Jun. 12, 2018

(54) DIRECTIONAL SOLIDIFICATION OF POLYCRYSTALLINE DIAMOND COMPACT (PDC) DRILL BITS

(71) Applicant: HALLIBURTON ENERGY SERVICES, INC.

(72) Inventors: William Brian Atkins, Houston, TX (US); Jeffrey Thomas, Magnolia, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 174 days.

(21) Appl. No.: 14/759,510

(22) PCT Filed: Mar. 15, 2013

(86) PCT No.: PCT/US2013/032276

§ 371 (c)(1),
(2) Date: Jul. 7, 2015

(87) PCT Pub. No.: WO2014/143001

PCT Pub. Date: Sep. 18, 2014

(65) Prior Publication Data

US 2015/0343528 A1 Dec. 3, 2015

(51) Int. Cl.
*B22D 19/06* (2006.01)
*B22D 19/14* (2006.01)
(Continued)

(52) U.S. Cl.
CPC ..... *B22D 27/045* (2013.01); *B22D 19/06* (2013.01); *B22F 7/08* (2013.01); *E21B 10/42* (2013.01);
(Continued)

(58) Field of Classification Search
CPC ..... B22D 19/06; B22D 19/14; B22D 27/04; B22D 27/045
(Continued)

(56) References Cited

U.S. PATENT DOCUMENTS 4,113,473 A 9/1978 Gauvry et al.
4,140,170 A 2/1979 Baum
(Continued)

FOREIGN PATENT DOCUMENTS

CN 2078789 6/1991
EP 0995876 4/2000
(Continued)

OTHER PUBLICATIONS

PCT International Preliminary Report on Patentability, PCT/2013/032276, dated Sep. 24, 2015, 10 pages.
(Continued)

*Primary Examiner* — Kevin P Kerns
(74) *Attorney, Agent, or Firm* — Alan Bryson; Parker Justiss, P.C.

(57) ABSTRACT

A method of manufacturing a rotary drill bit includes forming a mold having an inner surface and an outer surface, locating a metal mandrel within the mold, packing the mold around at least part of the mandrel with particulate matrix-forming material and installing an insulating material around at least an upper portion of the outer surface. The material is infiltrated in a furnace with a molten binding alloy and the mold including the insulating material is removed from the furnace, directionally solidifying the material and binding alloy in portion of the bit, wherein the directional solidification proceeds from the lower portion of the outer surface in an upward and outward direction to form a solid infiltrated matrix bonded to the mandrel by cooling of the mold with
(Continued)

the insulating material disposed around at least the upper portion of the outer surface of the mold.

11 Claims, 5 Drawing Sheets

(51) Int. Cl.

| | |
|---|---|
| ***B22D 27/04*** | (2006.01) |
| ***E21B 10/42*** | (2006.01) |
| ***B22F 7/08*** | (2006.01) |
| *B22F 7/06* | (2006.01) |
| *C22C 29/08* | (2006.01) |
| *B22F 5/00* | (2006.01) |

(52) U.S. Cl.
CPC ... *B22F 2005/001* (2013.01); *B22F 2007/066* (2013.01); *C22C 29/08* (2013.01)

(58) Field of Classification Search
USPC ..... 164/97, 122, 122.1, 122.2
See application file for complete search history.

(56) References Cited

U.S. PATENT DOCUMENTS

| | | | |
|---|---|---|---|
| 5,373,907 | A | 12/1994 | Weaver |
| 6,148,936 | A | 11/2000 | Evans et al. |
| 6,220,117 | B1 | 4/2001 | Butcher |
| 7,398,840 | B2 | 7/2008 | Ladi et al. |
| 7,905,161 | B2 | 3/2011 | Butler et al. |
| 2008/0127781 | A1 | 6/2008 | Ladi et al. |
| 2008/0141802 | A1 | 6/2008 | Smick et al. |
| 2009/0301682 | A1 | 12/2009 | Proske et al. |
| 2010/0278604 | A1 | 11/2010 | Glass et al. |

FOREIGN PATENT DOCUMENTS

| | | |
|---|---|---|
| EP | 1228828 | 8/2002 |
| GB | 2095383 | 9/1982 |
| GB | 2330787 | 5/1999 |
| GB | 2343194 | 5/2000 |
| GB | 2364529 | 1/2002 |
| GB | 2488508 | 5/2012 |
| WO | WO 9813159 | 4/1998 |
| WO | WO 2008/091793 | 7/2008 |
| WO | WO 2012/073099 | 6/2012 |

OTHER PUBLICATIONS

Chinese Office Action issued in Chinese Application No. 201380071530.9 by the State Intellectual Property Office of the People's Republic of China, dated Mar. 4, 2016.

Authorized officer Kim, Jin Ho in International Search Report and Written Opinion for International Application No. PCT/US2013/032276, dated Dec. 6, 2013, 13 pages.

DIRECTIONAL SOLIDIFICATION OF POLYCRYSTALLINE DIAMOND COMPACT (PDC) DRILL BITS

TECHNICAL FIELD

This present invention relates to directional solidification of PDC drill bits.

BACKGROUND

Rotary drill bits are frequently used to drill oil and gas wells, geothermal wells and water wells. Rotary drill bits may be generally classified as rotary cone or roller cone drill bits and fixed cutter drilling equipment or drag bits. Fixed cutter drill bits or drag bits are often formed with a matrix bit body having cutting elements or inserts disposed at select locations of exterior portions of the matrix bit body. Fluid flow passageways are typically formed in the matrix bit body to allow communication of drilling fluids from associated surface drilling equipment through a drill string or drill pipe attached to the matrix bit body. Such fixed cutter drill bits or drag bits may sometimes be referred to as "matrix drill bits."

Matrix drill bits are typically formed by placing loose matrix material (sometimes referred to as "matrix powder") into a mold and infiltrating the matrix material with a binder such as a copper alloy. The mold may be formed by milling a block of material such as graphite to define a mold cavity with features that correspond generally with desired exterior features of the resulting matrix drill bit. Various features of the resulting matrix drill bit such as blades, cutter pockets, and/or fluid flow passageways may be provided by shaping the mold cavity and/or by positioning temporary displacement material within interior portions of the mold cavity. A preformed steel shank or bit blank may be placed within the mold cavity to provide reinforcement for the matrix bit body and to allow attachment of the resulting matrix drill bit with a drill string.

A quantity of matrix material typically in powder form may then be placed within the mold cavity. The matrix material may be infiltrated with a molten metal alloy or binder which will form a matrix bit body after solidification of the binder with the matrix material. Tungsten carbide (WC) powder is often used to form conventional matrix bit bodies.

The methods described herein can advantageously reduce non-desirable cooling of the mold, resulting in improved characteristics of the matrix drill bit. By reducing the energy loss of the mold a further advantage is realized in reducing the energy required from the furnace.

DESCRIPTION OF DRAWINGS

Like reference symbols in the various drawings indicate like elements.

DETAILED DESCRIPTION

Figure 1:
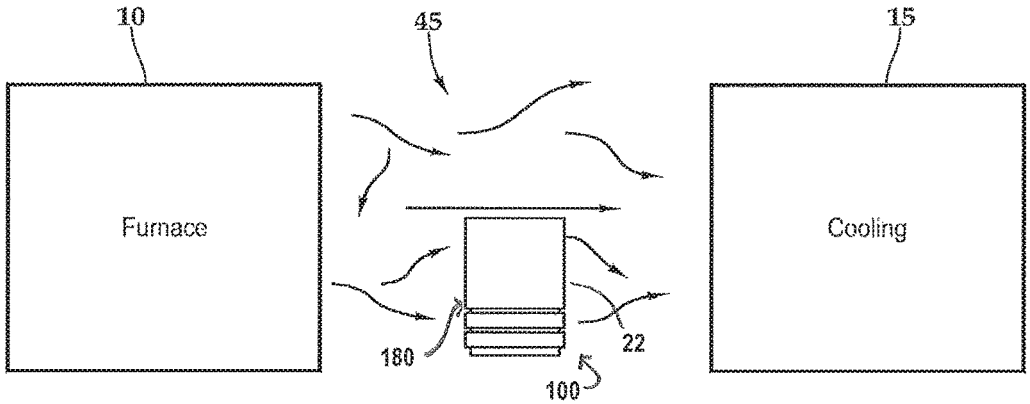
FIG. 1 is a schematic drawing showing a drill bit mold being removed from a hot furnace to begin cooling.

The terms "matrix drill bit" and "matrix drill bits" may be used in this application to refer to "rotary drag bits", "drag bits", "fixed cutter drill bits" or any other drill bit incorporating teaching of the present disclosure. Such drill bits may be used to form well bores or boreholes in subterranean formations.

In general, a matrix drill bit comprises a matrix powder infiltrated with a binder material in an infiltration process, as described in more detail below. The matrix powder generally lends desirable mechanical properties to a matrix drill bit such as a high resistance to abrasion, erosion and wear. The matrix powder can comprise particles of any erosion resistant materials which can be bonded (e.g., mechanically) with a binder to form a matrix drill bit. Suitable materials may include, but are not limited to, carbides, nitrides, natural and/or synthetic diamonds, and any combination thereof.

A matrix powder may comprise tungsten carbide. Various types of tungsten carbide may be used with the present invention, including, but not limited to, stoichiometric tungsten carbide particles, cemented tungsten carbide particles, and/or cast tungsten carbide particles. The first type of tungsten carbide, stoichiometric tungsten carbide, may include macrocrystalline tungsten carbide and/or carburized tungsten carbide. The second type of tungsten carbide, cemented tungsten carbide, may include sintered spherical tungsten carbide and/or crushed cemented tungsten carbide. The third type of tungsten carbide, cast tungsten carbide, may include spherical cast tungsten carbide and/or crushed cast tungsten carbide. Additional materials useful as matrix powder or as part of a matrix powder blend include, but are not limited to, silicon nitride ($Si_3N_4$), silicon carbide (SiC), boron carbide ($B_4C$), cubic boron nitride (CBN), and any other materials known to be useful as matrix powders.

To form matrix bit bodies via a tungsten carbide powder infiltration process, a furnace is used to heat WC powder, a binder alloy, and flux powder inside a mold of various material types. A preformed steel shank or mandrel may be placed within the mold cavity to provide reinforcement for the matrix bit body to be formed and to allow attachment of the resulting matrix drill bit with a drill string. The mold surrounding the mandrel is packed with WC powder and loaded with the binder alloy and flux, and then heated. At the binder alloy's melting point the binder alloy is infiltrated down into the spaces between the WC powder, forming a bond between the each of the WC powder particles and between the particles and the mandrel. The matrix bit body may be attached to a metal shank. A tool joint having a threaded connection operable to releasably engage the associated matrix drill bit with a drill string, drill pipe, bottom hole assembly or downhole drilling motor may be attached to the metal shank.

The terms "binder", "binding material" and/or "binder materials" may be used interchangeably in this application, and may be used in this application to include copper, cobalt, nickel, iron, zinc, manganese, tin, any alloys of these elements, any combinations thereof, or any other material satisfactory for use in forming a matrix drill bit comprising a matrix powder as described above. Such binder materials may have a solidification temperature range of 1600-1800 degrees F., for example 1670-1753 degrees F. Such binders generally provide desired ductility, toughness and thermal conductivity for an associated matrix drill bit. Other materials have previously been used as binder materials to provide resistance to erosion, abrasion and wear of an associated matrix drill bit. Binder materials may cooperate with two or more different types of matrix materials to form matrix bit bodies with increased toughness and wear properties as compared to many conventional matrix bit bodies.

Forming a coherent matrix of high quality is critical to a matrix body drill bit's strength and durability. Many factors affect the strength and durability of the finished matrix material: the size and packing density of the tungsten carbide powders, the composition and ratios of binders and flux, and the time and temperature relations involved in the heating and cooling processes.

FIG. 1 is a schematic drawing showing a drill bit mold assembly 100 containing matrix bit body 50 (not shown) being removed from a hot furnace 10 and transferred to begin a cooling process at a cooling station 15. During the transfer the generally cylindrical exterior sides 22 of cover 180 of the mold assembly 100 are exposed to surrounding air 45 of much lower temperature (generally ambient air temperature of from 70 to 90 degrees F.) than the temperature of furnace 10 (generally in the range of 2000 to 2200 degrees F.), while the lower surface is still in contact with the hot furnace hearth block. As a result, a cooling front starts on the upper surfaces of the mold such as the generally cylindrical exterior sides 22 of the mold assembly 100. This cooling front causes undesirable cooling effects on the mold assembly 100 and the bit within. These effects are known to cause defects in the infiltration of the WC powder, resulting in a tendency for the matrix to crack during the cooling of the matrix and mandrel following the infiltration of the matrix. Once on the cooling station 15 the mold assembly 100 is generally flushed with water at its lower surface to promote accelerated cooling from the lower surface.

Figure 2B:
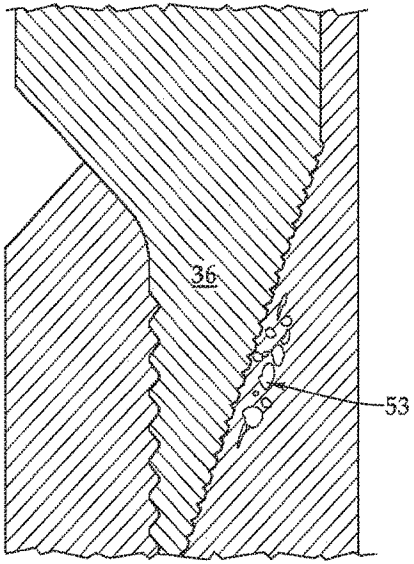
Fig.2B (PRIOR ART)
FIG. 2B is an enlargement of the cross section of a drill bit formed according to the prior art with the infiltrated matrix and mandrel ground down to a smooth interior surface of FIG. 2A.
Figure 2A:
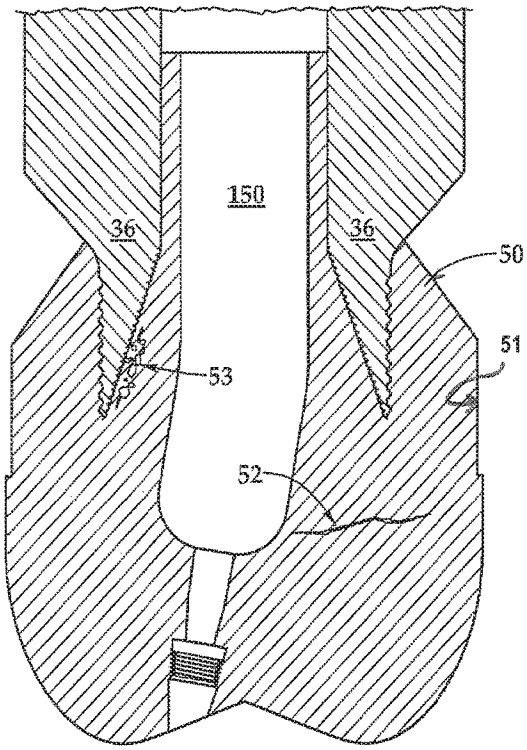
Fig.2A (PRIOR ART)
FIG. 2A is a cross section of a drill bit formed according to the prior art with the infiltrated matrix and mandrel ground down to a smooth interior surface.

An example of an undesirable cooling defect can be seen in FIGS. 2A and 2B. FIG. 2A shows a matrix bit body 50 that was formed inside a mold assembly 100 according to the prior art. In the figure, the generally cylindrical bit body 50 has been split down the approximate centerline, dividing the matrix bit body 50 into hemi-cylinders and exposing a generally flat interior surface 51 of the matrix bit body. The interior surface 51 and various bit inserts such as a core 150 and an annular mandrel 36 of partially triangular cross section that were embedded in the matrix (as described below) are visible.

The interior surface 51 has been ground and polished to easily visualize the characteristics of the interior surface. Visible in the matrix are defects 52, 53. Defect 52 is a crack large enough to be visible to the eye, approximately 1-2" in length. The large defect 53 is shown more clearly in FIG. 2B which corresponds to the highlighted region of FIG. 2A. The cracking and discontinuity of defect 53 are extensive, but not apparent without destroying the matrix drill bit 50 to inspect the interior. The defects would create weakened portions of the matrix drill bit 50, likely causing the bit to fail.

Figure 3:
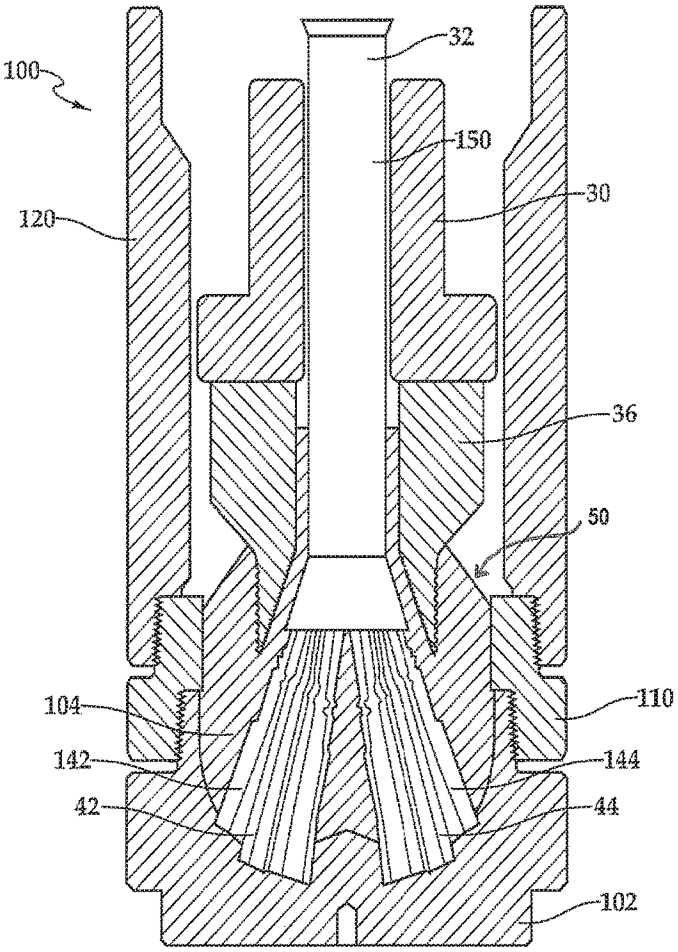
Fig.3 (PRIOR ART)
FIG. 3 is a schematic drawing in section with parts broken away showing a drill bit mold according to the prior art.

Such disruptions in the continuity of the matrix resulting in a weakened matrix bit body 50 can be ameliorated by causing the binder to solidify from the bottom of the mold to the top and from the inside out using insulation disposed on the outer surface of the mold 100 as illustrated in FIG. 3.

Figure 5:
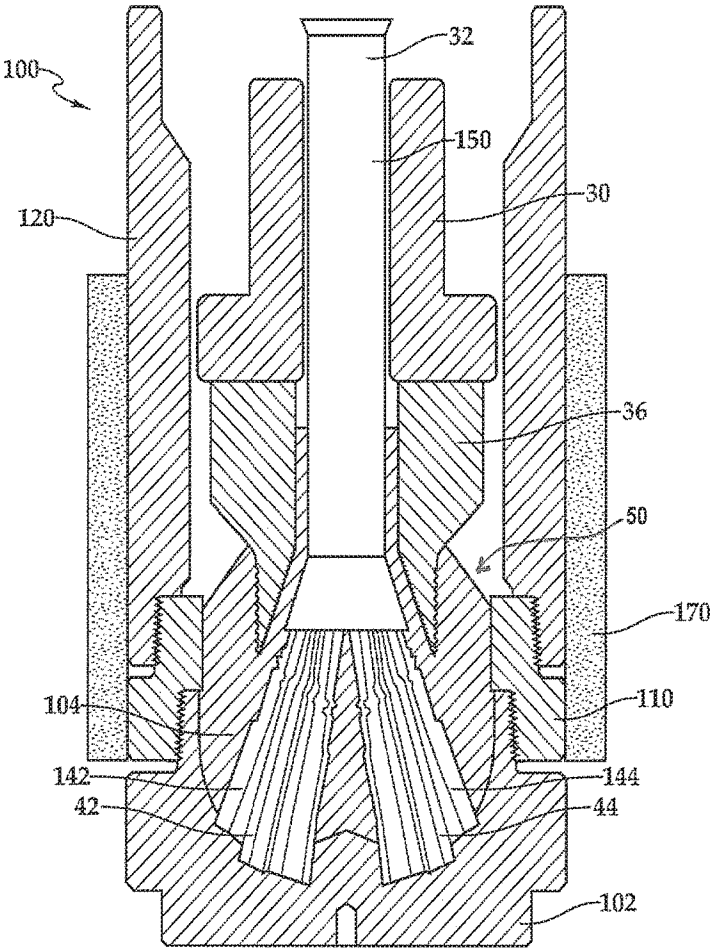
FIG. 5 is a schematic drawing in section with parts broken away showing a drill bit mold formed according to the present disclosure.

Referring to FIG. 3, the mold assembly 100 may include several components such as mold 102, a connector ring 110 and funnel 120. Mold 102, connector ring 110 and funnel 120 may be formed from graphite or other suitable materials. Various techniques may be used including, but not limited to, machining a graphite blank to produce mold 102 with cavity 104 having a negative profile or a reverse profile of desired exterior features for a resulting fixed cutter drill bit. For example mold cavity 104 may have a negative profile which corresponds with the exterior profile or configuration of blades and junk slots or fluid flow passageways. Mold assembly 100 as shown in FIGS. 3 and 5 represents only one example of a mold assembly satisfactory for use in forming a matrix bit body incorporating teachings of the present disclosure. A wide variety of molds may be satisfactorily used to form a matrix bit body and associated matrix drill bit in accordance with teachings of the present disclosure.

To form a matrix bit body 50, a generally cylindrical metal blank or mandrel 36 may be attached to a hollow, generally cylindrical metal shank 30 using various techniques. A fluid flow passageway or longitudinal bore 32 preferably extends through metal shank 30 and mandrel 36. Mandrel 36 and metal shank 30 may be formed from various steel alloys or any other metal alloy associated with manufacturing rotary drill bits. Although shown inside the mold assembly 100 in FIG. 3, shank 30 is generally attached to mandrel 36 after the matrix bit body 50 is infiltrated, cooled, and removed from the mold assembly 100.

Various examples of blades and/or cutting elements which may be used with a matrix bit body incorporating teachings of the present disclosure. It will be readily apparent to persons having ordinary skill in the art that a wide variety of fixed cutter drill bits, drag bits and other drill bits may be satisfactorily formed with a matrix bit body incorporating teachings of the present disclosure. The present disclosure is not intended to limit the characteristics of the resulting matrix drill bit to any specific features as shown in FIG. 3.

A plurality of mold inserts (not shown) may be placed within cavity 104 to form respective pockets. The location of the mold inserts in cavity 104 corresponds with desired locations for installing cutting elements and associated blades. These cutting elements may scrape and gouge formation materials from the bottom and sides of a wellbore during rotation of a matrix drill bit by an attached drill string. For some applications various types of polycrystalline diamond compact (PDC) cutters may be satisfactorily used as inserts. A matrix drill bit having such PDC cutters may sometimes be referred to as a "PDC bit". The mold inserts may be formed from various types of material such as, but not limited to, consolidated sand and graphite.

Various types of temporary displacement materials may be installed within mold cavity 104, depending upon the desired configuration of a resulting matrix drill bit. Additional mold inserts (not expressly shown) formed from various materials such as consolidated sand and/or graphite may be disposed within mold cavity 104. Various resins may be satisfactorily used to form consolidated sand. Such mold inserts may have configurations corresponding with desired exterior features of bit body 50 such as fluid flow passageways.

Matrix bit body 50 may include a relatively large fluid cavity or chamber 32 with multiple fluid flow passageways 42 and 44 extending therefrom. As shown in FIG. 2, displacement materials such as consolidated sand may be installed within mold assembly 100 at desired locations to form portions of cavity 32 and fluid flow passages 42 and 44 extending therefrom. Such displacement materials may have various configurations. The orientation and configuration of consolidated sand legs 142 and 144 may be selected to correspond with desired locations and configurations of associated fluid flow passageways 42 and 44 communicating from cavity 32. Fluid flow passageways 42 and 44 may receive threaded receptacles (not expressly shown) for holding respective nozzles therein.

A relatively large, generally cylindrically shaped consolidated sand core 150 may be placed on the legs 142 and 144. Core 150 and legs 142 and 144 may be sometimes described as having the shape of a "crow's foot." Core 150 may also be referred to as a "stalk." The number of legs extending from core 150 will depend upon the desired number of nozzle openings in a resulting bit body. Legs 142 and 144 and core 150 may also be formed from graphite or other suitable material.

After desired displacement materials including core 150 and legs 142 and 144 have been installed within mold assembly 100, a matrix material may be placed within mold assembly 100, as well as a binder which infiltrates the matrix material when heated in the furnace 10.

To reduce the problem presented by the undesirable temperature gradient, an insulating layer 170 of material is applied to the exterior of the mold that reflects or insulates the mold from heat loss, as shown in FIG. 5. Applying this insulating layer 170 to the mold assembly 100 significantly reduces non-desirable cooling of the mold assembly 100 and matrix drill bit 50. The insulating layer 170 should be made of thermally generally non-conductive materials and/or materials with low thermal conductivity properties.

As shown in FIG. 5, upper portions of mold assembly 100 such as funnel 120 have insulating layer 170 placed around the cylindrical exterior sides 22 of the mold. As a result, hot, liquid binder material in lower portions of mold assembly 100 will generally start to solidify at a bottom region of the mold before hot, liquid binder material solidifies at an upper region of the mold. Insulating layer 170 may cover the outer surfaces of connector ring 110 and funnel 120 in their entirety, or may cover only a portion of connector ring 110 and funnel 120. Insulating layer 170 may also cover a top surface of the mold assembly 100.

The insulating layer 170 can include a reflective surface disposed toward at least an upper portion of the outer surface of the mold. The insulating material 170 can be preformed in a plurality of insulation pieces and installing the insulating layer 170 can include assembling said pre-formed insulation pieces to form a generally cylindrical shape wherein an inner surface of the cylindrical shape conforms to the upper portion of the outer surface of the mold.

Placement of insulating layer 170 around the mold assembly when cooling causes the binder to solidify from the bottom of the mold to the top and from the inside to the outside, as shown by the green curves in FIG. 5. This results in a directional solidifying of the material and binding alloy in the bit, with directional solidification proceeding from the lower portion of the outer surface in an upward and outward direction to form a solid infiltrated matrix bonded to the mandrel by cooling of the mold with the insulating material disposed around at least the upper portion of the outer surface of the mold. As a result, the solid infiltrated matrix of the matrix bit body 50 proximal to an area of the outer surface of the mold where the insulating layer 170 is disposed has fewer discontinuities than the same area of a bit manufactured by a substantially similar process without the insulating layer 170 disposed around an upper portion of the outer surface of the mold.

Figure 4:
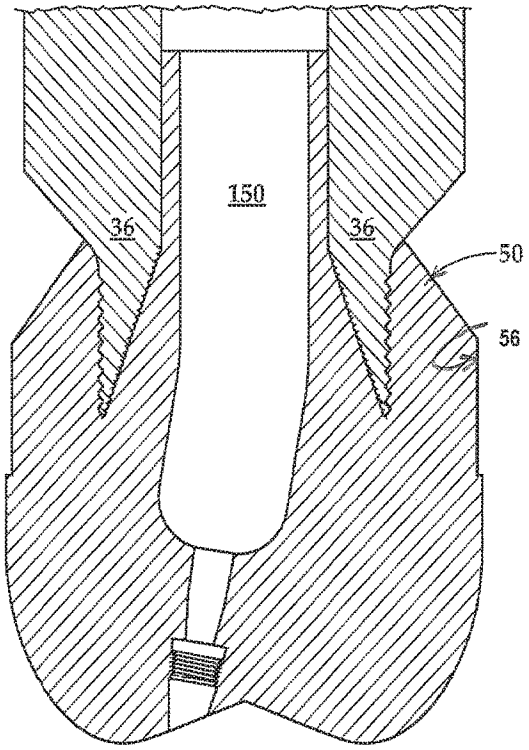
FIG. 4 is a cross section of a drill bit formed according to the present disclosure with the infiltrated matrix and mandrel ground down to a surface.

Shown in FIG. 4 is a cross section of a matrix bit body 50 that was formed inside a mold assembly 100 using directional solidifying according to the invention. As in FIG. 2A, the generally cylindrical bit body 50 has been split to divide the matrix bit body 50 into hemi-cylinders to expose a generally flat interior surface 56 of the matrix bit body. The core 150 and annular mandrel 36 embedded in the matrix are visible. However, as can be seen in the figure, the ground and polished interior surface 56 is smooth and free of defects. This results in more uniform, stronger matrix which is less prone to failure.

Figure 6:
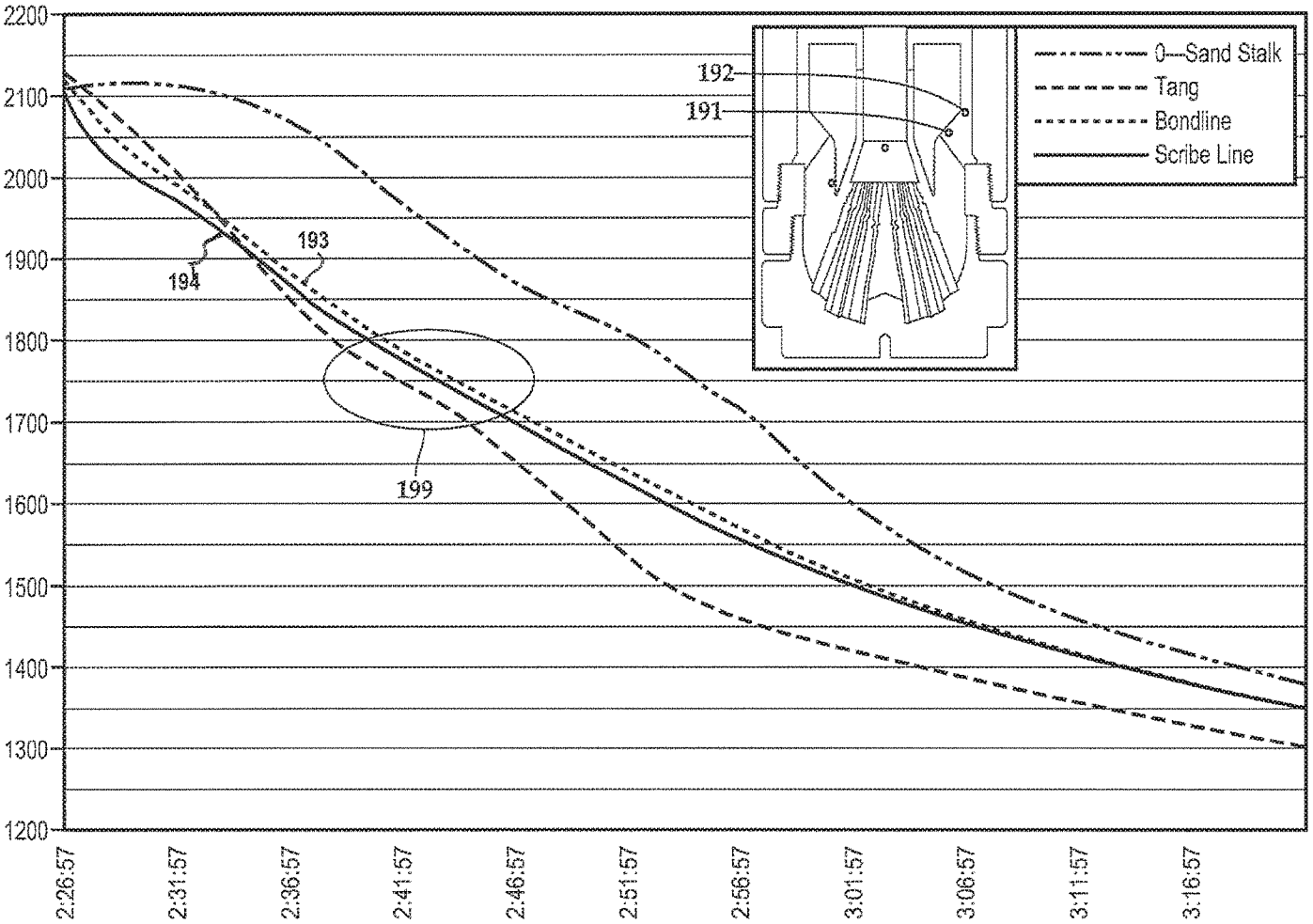
FIG. 6 is a graphical representation of the variation in temperature with time at various locations inside the drill bit mold according to FIG. 3.
Figure 7:
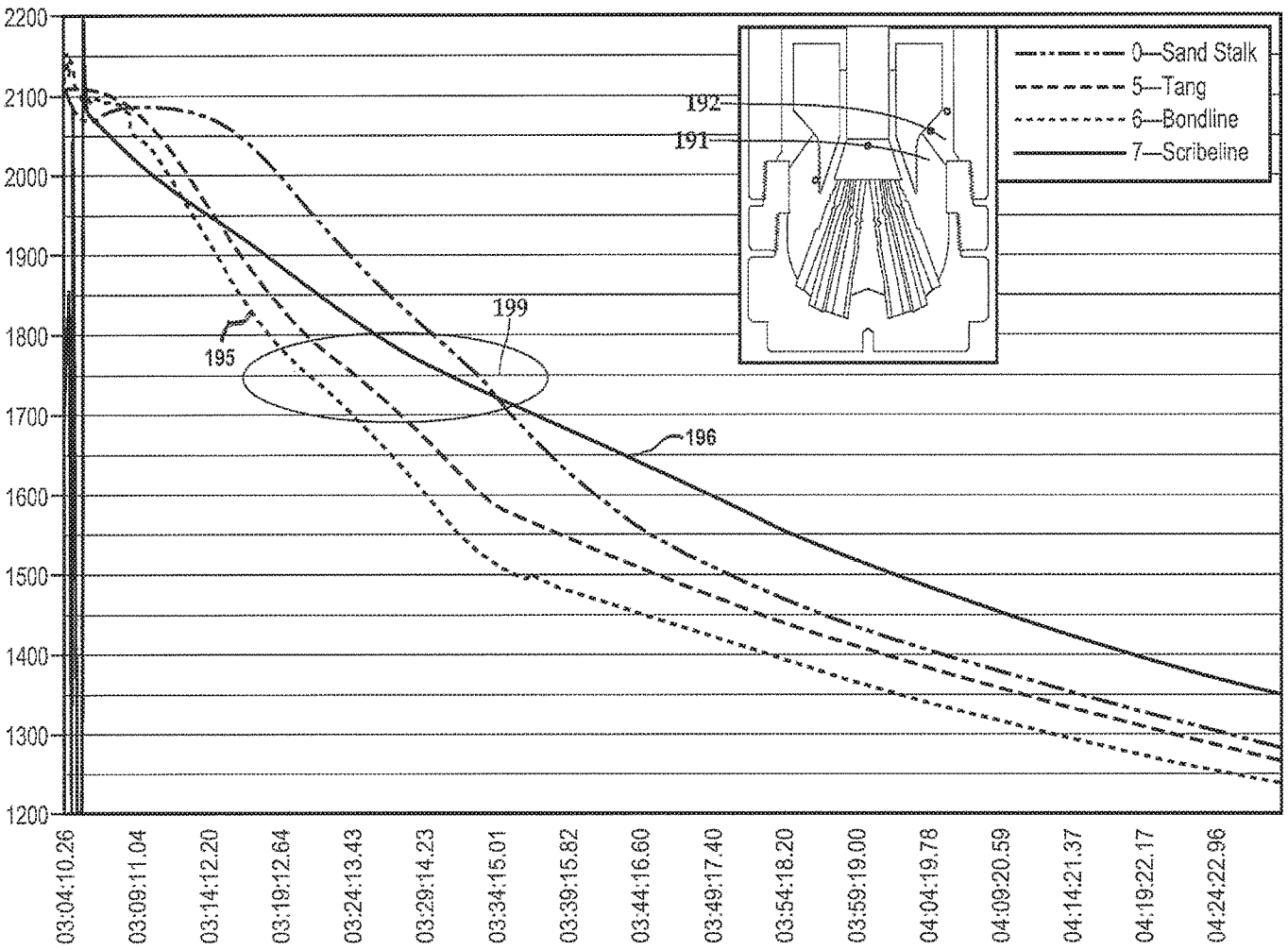
FIG. 7 is a graphical representation of the variation in temperature with time at various locations inside the drill bit mold according to FIG. 4.

The binder materials have a solidification temperature (i.e., temperature at which the liquid metal becomes a solid) of approximately 1700 degrees F. As shown in FIGS. 6 and 7, some fixed cutter drill bit designs cooled with an insulating layer 170 indicate an improvement in a temperature change profile compared with the same design of fixed cutter drill bit mold having a matrix bit body formed using only commercially available molds and cooling systems.

The legends in FIGS. 6 and 7 corresponding generally to the bit body 50 and parts of mold assembly 100 as shown in FIGS. 3 and 5. A first position 191 indicates a temperature measurement location that in more central and closer to a bottom region of the mold 102 compared to a second position 192. The critical solidification zone 199 (i.e., between approximately 1700 and 1800 degrees) where the matrix bit material solidifies from a liquid to a solid is highlighted. In FIG. 6, the curves 193 and 194 show an example of temperature vs. time measurements taken at the first position 191 and the second position 192 during the cooling process once the mold assembly has been removed from the furnace 10 using a mold of the prior art (such as in FIG. 3). The curves 193 and 194 are nearly identical, indicating that all temperature changes occurred approximately at the same time in the two locations. These near-identical temperature profiles show that the solidification front would have occurred at nearly the same time in both locations, indicating an unwanted rapid cooling across the region.

FIG. 7 shows curves 195 and 196 corresponding to examples of temperature vs. time measurements taken at the first position 191 and the second position 192 during the cooling process once the mold assembly has been removed from the furnace 10 using a mold of the current disclosure (such as in FIG. 5). In contrast to the near-identical curves 193 and 194 of FIG. 6, with insulating layer 170 in place a separation in the curves corresponding to the first location 191 and the second location 192 is clearly visible. In this case, the first position 191 represented by the temperature profile of curve 195 enters the critical solidification zone 199 well in advance of the second position 192 represented by the temperature profile of curve 196. This separation in the two curves 195, 196 indicates a more uniform, gradual solidification front occurring as a result of the insulating layer 170, with the second position 192 more distant from the center and bottom compared to the first position 191 solidifying well after the first position 191. Note that other curves in FIGS. 6 and 7 indicate various controls.

Figure 8:
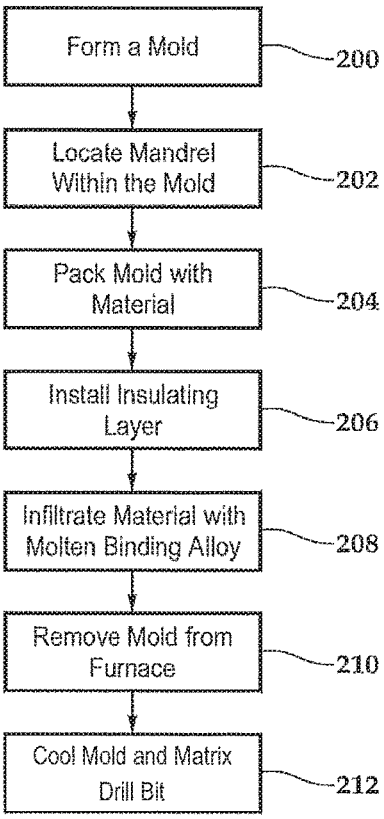
FIG. 8 is a flow chart describing a sequence of steps to be used in using the drill bit mold according to FIG. 4.

The following description of an infiltration process is intended only as an example of infiltration processes generally for casting matrix body drill bits. A typical infiltration process for casting a matrix bit body 50, shown in FIG. 8, may begin at step 200 by forming the mold assembly 100. Forming the mold assembly 100 may include, e.g., threading a connector ring 110 onto the top of mold 102. Funnel 120 may be threaded onto the top of connector ring 110 to extend mold assembly 100 to a desired height to hold matrix materials and binder material. Forming the mold assembly may also include casting or otherwise creating the mold assembly. The mold assembly and various parts thereof can be formed of graphite, sand, ceramics, and/or boron nitride. Forming the mold assembly may further include imprinting a layer of sand covering at least the upper portion of the inner surface of the mold wherein said sand further insulates the solidifying material during the cooling of the mold. It will be understood that the present invention may be successfully practiced without the imprinted sand layer.

In addition, forming the mold assembly 100 may further include inserting a secondary mold into the first/primary mold with a layer of sand covering at least the upper portion of the inner surface of the mold wherein said sand further insulates the solidifying material during the cooling of the mold. It will be understood that the present invention may be successfully practiced without the secondary mold.

In step 202 displacement materials such as, but not limited to, mandrel 36 as well as mold inserts, legs 142 and 144, and core 150 may then be loaded into mold assembly 100. Any technique known in the art for determining the positioning of these displacement materials relative to the mold assembly 100 or each other may be used. As well, any known technique for fixing the displacement materials in their desired positions once determined may be used.

In step 204, the mold assembly 100 is packed. This comprises filling the mold assembly 100 with matrix materials including packing the matrix material around at least part of the mandrel. A series of vibration cycles may be induced in the mold assembly 100 to assist packing of the matrix materials. The vibrations help to ensure consistent density of the matrix materials within respective ranges required to achieve desired characteristics for matrix bit body 50.

A binder material may be placed on top of the matrix material and mandrel 36. The binder material may be covered with a flux layer (not expressly shown).

In step 206, insulating layer 170 is installed around a portion of the upper outer surface of the mold 102. The insulating layer 170 may be permanently or semi-permanently attached to a cover 180 or lid which may be placed over mold assembly 100. Alternatively, the cover 180 may be first placed over the mold 102 and the insulating layer 170 placed in an additional layer over the cover.

The molten binding alloy is then infiltrated into the matrix material by heating in step 208. The infiltration process may include a pre-heat step in which mold assembly 100 and materials disposed therein are heated to 200-300 degrees F. prior to placement in the furnace 10. The furnace may have a temperature of approximately 2000-2200 degrees F. The packed mold assembly is placed in the furnace 10 and heated at least until the binder material reaches its melting temperature, which can be (approximately 1700 degrees F.), at which point the liquid binder material liquefies and infiltrates the matrix materials. An additional heat or soak time ranging from 0-15 minutes in which the packed mold assembly 100 reaches a temperature of approximate 2000-2100 degrees F. may be used to ensure complete melting and uniformity of the matrix mixture. Furnace heating time will vary from 30 min to 3 hrs. depending on bit size.

Mold assembly 100 may then be removed from the furnace in step 210. Controlled cooling (step 212) via directional solidification of the material and binding alloy in a lower portion of the resulting bit then occurs. The directional solidification proceeds from the lower portion of the outer surface in an upward and inward direction to form a solid infiltrated matrix bonded to the mandrel by cooling of the mold with the insulating layer disposed around at least the upper portion of the outer surface of the mold. The controlled cooling step may include water quenching from the bottom of the mold assembly 100. The controlled cooling step may also including removing the insulating layer 170 after the internal temperature of the solidifying material in a portion of the bit has cooled to below 1700 degrees F., but before it reaches temperature of the lower-temperature surrounding air 45.

Once cooled, mold assembly 100 may be broken away to expose matrix bit body 50. Subsequent processing according to well-known techniques may be used to produce the final features of a desired matrix drill bit.

A number of embodiments of the invention have been described. Nevertheless, it will be understood that various modifications may be made without departing from the spirit and scope of the invention. Accordingly, other embodiments are within the scope of the following claims.

What is claimed is:

1. A method of manufacturing a rotary drill bit comprising a bit body having a shank for connection to a drill string and a leading face on which cutters are mounted, the method comprising:

forming a mold assembly, said mold assembly comprising at least a mold for said bit, a connector ring, and a funnel, said mold assembly having an inner surface and an outer surface;

locating a metal mandrel within the mold assembly, packing the mold assembly around at least part of the metal mandrel with particulate matrix-forming material, the metal mandrel positioned between said connector ring and said funnel;

installing an insulating material around at least exterior sides of the outer surface, said insulating material laterally adjacent at least the metal mandrel and the connector ring, but not extending substantially below the connector ring;

infiltrating said matrix forming material in a furnace with a molten binding alloy;

removing the mold assembly including the insulating material on the outer surface from the furnace;

directionally solidifying the matrix forming material and binding alloy in a portion of said bit, wherein said directional solidification proceeds from the lower portion of the outer surface in an upward and outward direction to form a solid infiltrated matrix bonded to the metal mandrel by cooling of the mold assembly with the insulating material disposed at least adjacent the metal mandrel and the connector ring.

2. The method of claim 1 further including removing the insulating material after the internal temperature of the solidifying material in the portion of the bit has cooled to below 1700 degrees F.

3. The method of claim 1 further including forming the mold of graphite.

4. The method claim 3 wherein forming the mold further includes imprinting a layer of sand covering at least an upper portion of the inner surface of the mold wherein said sand further insulates the solidifying material during the cooling of the mold.

5. The method claim 3 wherein forming the mold further includes inserting a secondary mold into the first/primary mold with a layer of sand covering at least the upper portion of the inner surface of the mold wherein said sand further insulates the solidifying material during the cooling of the mold.

6. The method of claim 1 further including forming the mold of sand.

7. The method of claim 1 further including forming the mold of ceramics.

8. The method of claim 1 further including forming the mold of boron nitride.

9. The method of claim 1 wherein the insulating material includes a reflective surface disposed toward at least the upper portion of the outer surface of the mold.

10. The method of claim 1 wherein the insulating material is pre-formed in a plurality of insulation pieces and said method of installing includes assembling said pre-formed insulation pieces to form a substantially cylindrical shape wherein an inner surface of the cylindrical shape conforms to the at least upper portion of the outer surface of the mold.

11. A method of reducing discontinuities in the matrix of a rotary bit body, said bit body having a shank for connection to a drill string and a leading face on which cutters are mounted, the method comprising:

forming a mold assembly, said mold assembly comprising at least a mold for said bit body, a connector ring, and a funnel, said mold assembly, said mold assembly having an inner surface and an outer surface;

locating a metal mandrel within the mold, packing the mold assembly around at least part of the metal mandrel with particulate matrix-forming material, the metal mandrel positioned between said connector ring and said funnel;

installing an insulating material around at least exterior sides of the outer surface, said insulating material laterally adjacent at least the metal mandrel and the connector ring, but not extending substantially below the connector ring;

infiltrating said matrix forming material in a furnace with a molten binding alloy;

removing the mold assembly including the insulating material on the outer surface from the furnace;

cooling of the mold assembly with the insulating material disposed at least adjacent the metal mandrel and the connector ring to form a solid infiltrated matrix bonded to the mandrel;

wherein at least a portion of the solid infiltrated matrix of the bit body proximal to an area of the outer surface of the mold assembly where the insulating material is disposed, has fewer discontinuities than the same area of a bit manufactured by a substantially similar process without insulating material disposed at least adjacent the metal mandrel and the connector ring.

* * * * *